US005577663A

United States Patent [19]

Nally et al.

[11] Patent Number: 5,577,663

[45] Date of Patent: Nov. 26, 1996

[54] BOTTOM FEED INJECTOR WITH TOP CALIBRATION FEED

[75] Inventors: Debora E. Nally, Williamsburg; David P. Wieczorek, Newport News, both of Va.

[73] Assignee: Siemens Automotive Corporation, Auburn Hills, Mich.

[21] Appl. No.: 444,494

[22] Filed: May 19, 1995

[51] Int. Cl.[6] ..... F02M 51/06

[52] U.S. Cl. ..... 239/1; 239/585.4

[58] Field of Search ..... 251/129.09; 239/585.1–585.5, 239/533.3–533.12, 600, 1, 5; 73/196, 195

[56] References Cited

U.S. PATENT DOCUMENTS

| | | | |
|---|---|---|---|
| 5,156,341 | 10/1992 | Terakado et al. | 239/585.4 |
| 5,158,236 | 10/1992 | Sugiyang et al. | 239/585.4 X |
| 5,185,297 | 2/1993 | Asano | 239/585.3 |
| 5,275,341 | 1/1994 | Romann et al. . | |
| 5,330,153 | 7/1994 | Reifer | 239/585.4 X |
| 5,348,233 | 9/1994 | Press et al. . | |

FOREIGN PATENT DOCUMENTS

| | | | |
|---|---|---|---|
| 75759 | 4/1985 | Japan | 239/585.4 |

*Primary Examiner*—Kevin Weldon
*Attorney, Agent, or Firm*—Russel C. Wells

[57] ABSTRACT

A bottom feed engine fuel injector is provided with a valve spring calibration adjuster such as an adjusting tube, which permits fuel flow from the top of the injector during manufacturing calibration and run in. The upper end of the injector is capped in the last manufacturing step after calibration to prevent fuel passage through this opening in normal engine use where bottom fuel feed is used in conventional fashion. Several exemplary adjusters and top feed closing embodiments are illustrated and described. The modified injector structure and manufacturing process reduces costs by allowing both top and bottom feed injectors to be assembled and calibrated on the same manufacturing equipment.

20 Claims, 3 Drawing Sheets

BOTTOM FEED INJECTOR WITH TOP CALIBRATION FEED

FIELD OF THE INVENTION

This invention relates to bottom feed fuel injectors for internal combustion engines and to improved embodiments and methods of manufacture for such injectors.

BACKGROUND OF THE INVENTION

In the art relating to engine fuel injectors for fuel delivery to engine induction systems, the commonly used types of injectors fall into two categories. These are top feed injectors wherein fuel is fed to the injector through an opening at the upper end and bottom feed (sometimes called side feed) injectors wherein fuel is fed to the injector through side openings located near the outlet nozzle end of the injector. Because of differences in the design, as well as the manner of fuel feed, these two types of injectors have traditionally been manufactured on separate assembly lines. This requirement adds to the cost of manufacture and limits flexibility as to the amounts of different types of injectors which may be economically produced.

Recently proposed injector assembly techniques have opened the possibility of having common components between bottom feed and top feed injector designs, allowing assembly of either type of injector on the same equipment. However, because of the differences in the fuel feed arrangements for the two injector types, the necessity continues for having a separate calibration and assembly line with different forms of fuel feeding equipment.

SUMMARY OF THE INVENTION

The present invention provides improved embodiments of bottom feed injectors which utilize calibration means similar of those of top feed injectors and allow fuel for calibration and run in to be delivered through the top of the injector in the same manner as with top feed injectors. Means for blocking off the side inlet ports of the bottom feed injector must also be provided on the line. Thus, both top feed and bottom feed injectors are able to be assembled, calibrated and run in on the same manufacturing line, reducing the overall manufacturing cost and increasing flexibility.

These and other features and advantages of the invention will be more fully understood from the following description of certain exemplary embodiments of the invention taken together with the accompanying drawings.

DETAILED DESCRIPTION OF THE INVENTION

Figure 1:
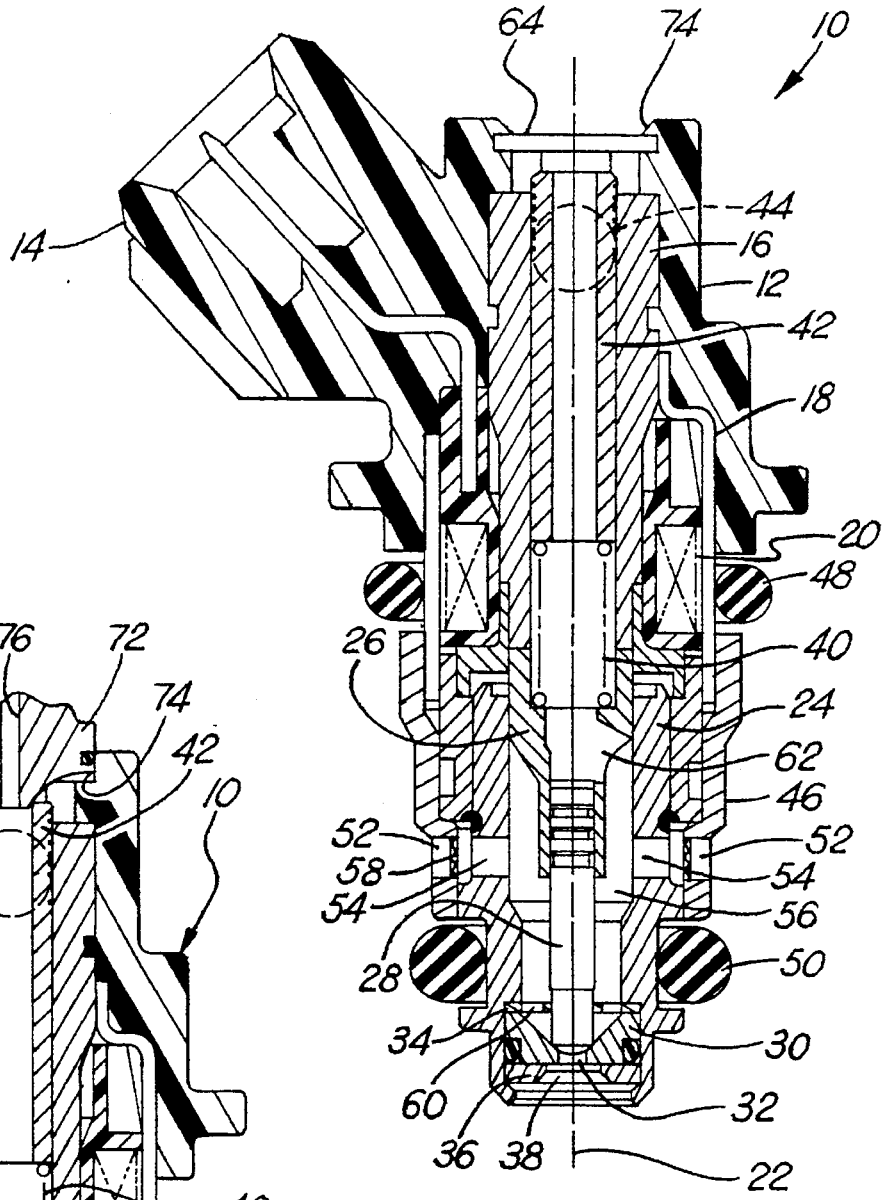
FIG. 1 is a longitudinal cross-sectional view of a bottom feed fuel injector formed according to the invention.

Referring now to the drawings in detail, numeral 10 generally indicates a bottom feed fuel injector in accordance with the invention. Injector 10 includes an over-molded plastic upper housing 12 including a connector 14. The housing 12 surrounds upper portions of an inlet tube 16 and a coil housing assembly 18 enclosing an annular magnetic coil 20 disposed around the lower end of the inlet tube 16 and having a common axis 22 therewith. Below the coil 20 is a valve body 24 in which an armature 26 is reciprocally disposed. The armature forms an assembly with a valve needle 28, the lower end of which normally engages a valve seat 30 having an outlet orifice 32. The valve seat 30 is received within a lower recess portion of the valve body together with a needle guide 34 above the valve seat and a backup washer 36 below having a central opening 38 aligned with the orifice 32.

The valve needle is normally urged against the seat 30 by a spring 40 which engages the upper end of the armature 26. The spring 40 is compressed by an adjusting tube 42 which is received with a friction fit within the inlet tube 16. The adjusting tube 42 is longitudinally adjusted within the inlet tube 16 to calibrate the spring force during manufacturing and is preferably staked or otherwise fixed in place after calibration, such as at the location of circle 44.

An outer plastic shell 46 covers the lower portion of the injector surrounding the upper portion of the valve body 24 and extending axially between upper and lower O-ring seals 48, 50 respectively. Between the seals 48, 50, radial openings 52 through the shell 46 join connecting openings 54 in the valve body to permit fuel flow from the exterior of the injector between the O-rings into an annular chamber 56 surrounding the valve needle 28. A filter screen 58 surrounds the valve body between openings 52 and 54.

In normal operation in an engine, fuel is admitted to the injector through the bottom (side) openings 52, 54, filling the chamber 56. When the coil 20 is energized, it attracts the armature 26 and unseats the valve needle 28 from the seat 30, allowing fuel to flow through openings 60 in the needle guide, past the valve seat and out through orifice 32 and opening 38 into an associated engine intake manifold or cylinder head not shown.

In prior bottom feed injectors, the spring force calibrating device is a solid rod forced into the inlet tube against the spring 40 and staked in place after calibration. One or more O-ring seals are located in grooves on the rod in order to prevent fuel leakage from the annular chamber 56 up through an opening 62 in the armature and out through the top of the injector. An additional closure seal in the form of a disk 64 is usually provided to close the housing opening.

Figure 2:
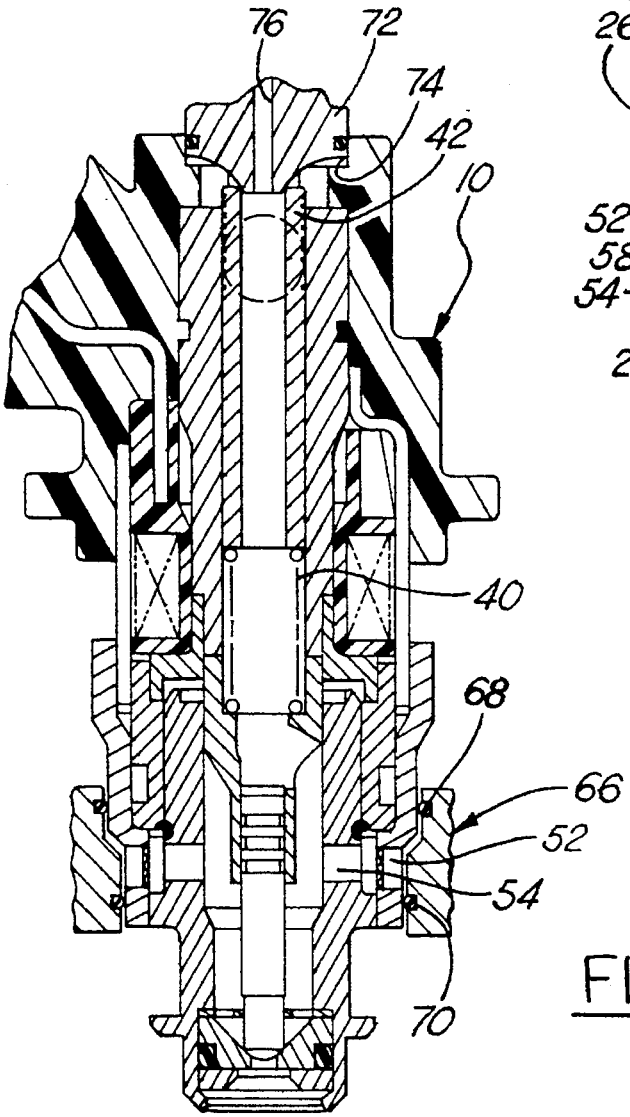
FIG. 2 is a cross-sectional view similar to FIG. 1 but showing the injector of FIG. 1 during calibration on the assembly line.

The present invention differs from the prior art in the use of a hollow adjusting tube 42 of the type that is usually limited to use in top feed injectors. During manufacture of the injector on the assembly line, the injector is assembled to a finished state except that the closure disk 64 is not installed at this point, as is shown in FIG. 2. The injector 10 is then placed in a fixture 66 which encloses the lower inlet openings 52, 54 between upper and lower seal rings 68, 70 respectively. These prevent the passage of fuel into or out of the inlet openings 52, 54. The injector is then connected with an alternative source of fuel delivery to the open top of the injector in the form of a nozzle 72 which sealingly engages a recess 74 in the top of the injector housing. Nozzle 72 also engages the inlet end of the adjusting tube 42 so as to deliver fuel through a passage 76 in the nozzle to the interior of the adjusting tube 42.

Calibration of the injector by adjusting as necessary the position of the adjusting tube is conducted during manufacture with top feeding of the fuel in substantially the same manner as top feed injectors are fed during manufacture. If desired the injector may also be run in using the top feed fuel nozzle. After the calibration and run in steps are completed, the top end of the injector is sealed by application of the closure disk 64 as shown in FIG. 1. The injector is then ready for use in an engine wherein the fuel will be bottom fed through the side port openings 52, 54 as previously discussed.

The manner of blocking the openings 52, 54 and feeding fuel to the upper end of the injector as shown in FIG. 2 is intended to be representative only and not to limit the manner in which these functions may be carried out, since any suitable manner of accomplishing them may be utilized. In like manner, closing of the upper end fuel feed opening may be performed in any suitable manner. However, a number of possible alternative embodiments are shown in FIGS. 3 through 11 to be subsequently described.

Figure 3:
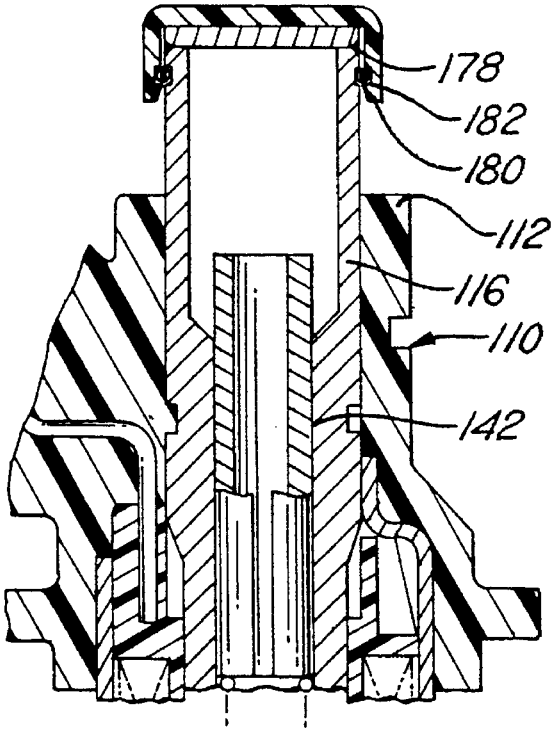
FIG. 3 is a fragmentary cross-sectional view of an injector having an alternative embodiment of sealing and adjusting means.

FIG. 3 illustrates an alternative embodiment of injector 110 which differs from injector 10 in two ways. First, a roll pin 142 is used in place of the normal adjusting tube 42 for calibrating and retaining the injector valve spring in its calibrated position. The roll pin is sized to fit within the lower bore of the inlet tube 116 with a snug fit so as to be useable in the same manner as the adjusting tube previously described. Second, the inlet tube 116 is extended beyond the upper housing 112 and the open end is closed by a disk 178 hermetically welded to the end of the tube 116. A cup shaped cap 180 is then provided which snaps over a retainer ring 182 held in a groove on the inlet tube exterior to retain the cap 180 in place covering the exposed metal of the disk 178 and tube 116 to maintain its appearance.

Figure 4:
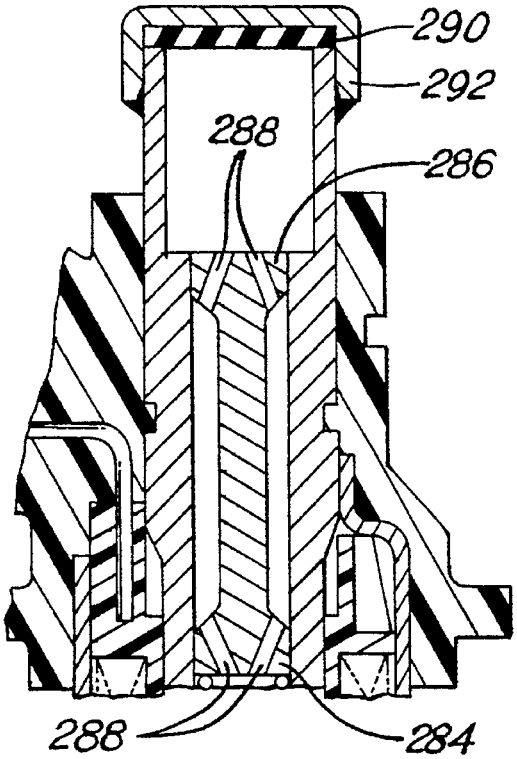
FIG. 4 is a view similar to FIG. 3 but showing but showing another embodiment of alternative sealing and adjusting means.

FIG. 4 shows an injector 210 which is similar to injector 110 except that it has a different form of adjusting means and top closure. An adjusting rod 242 is retained within the inlet tube 216 in place of the usual adjusting tube. Rod 242 has an enlarged lower end 284 engaging the valve spring and an enlarged upper end 286 fixed within the inner bore of the inlet tube 216. Passages 288 through the enlarged ends provide for fuel flow from the top feed through the upper end, around the reduced diameter of the adjusting rod 242 between its ends, and through the lower end 284 into the spring for delivery down through the fuel passage to the needle valve, not shown. The extended upper end of the inlet tube 216 is closed by a resilient disk 290 or an O-ring retained in place by a metal cap 292 which may be hermetically welded to the inlet tube exterior to provide, with the disk 290, a double seal against fuel leakage.

Figure 5:
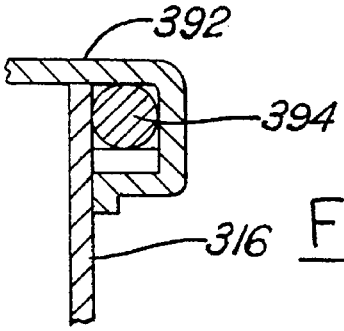
FIGS. 5–11 are fragmentary cross-sectional views illustrating alternative embodiments of sealing means.
Figure 6:
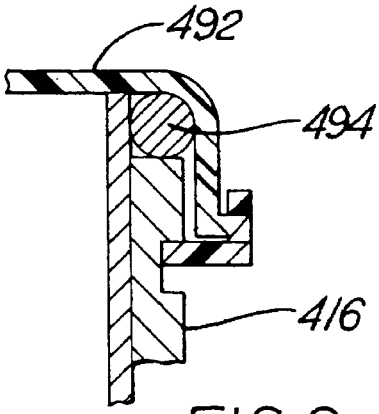

FIGS. 5 and 6 show alternative forms of upper closures in which an exterior O-ring 394 or 494 is retained in place on the inlet tube 316, 416 by a covering cap 392, 492. In FIG. 5, cap 392 is welded in place while in FIG. 6 cap 492 is retained by a clip or other retaining means.

Figure 7:
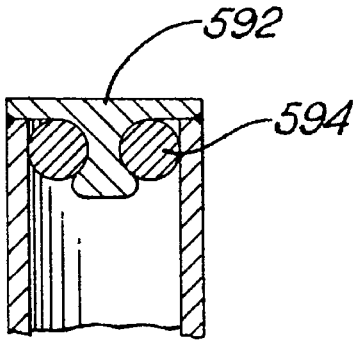

FIG. 7 illustrates one form of internal O-ring 594 received within the end of the inlet tube 516 and retained in place by a cap 592 which may be welded in any suitable manner to the inlet tube or retained on it in any other suitable manner.

Figure 8:
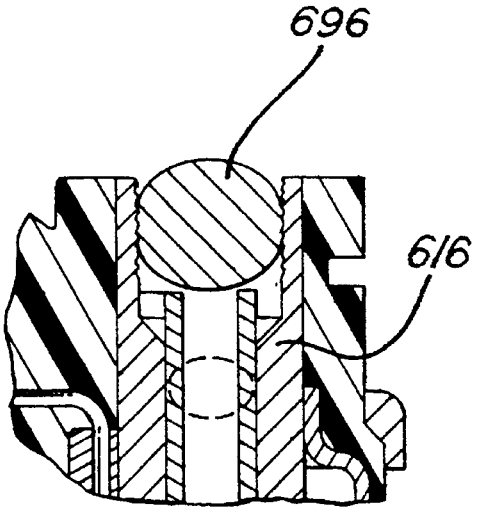
Figure 9:
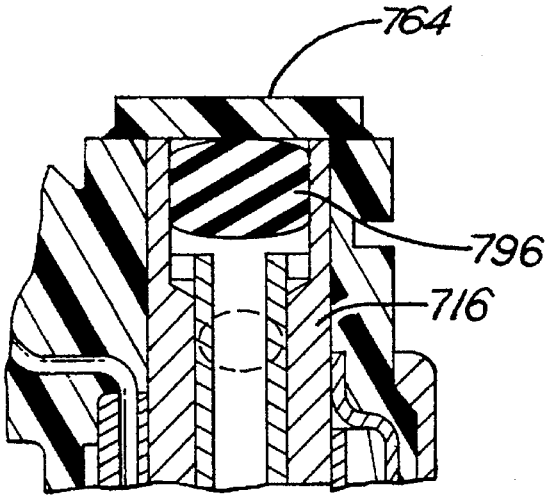
Figure 10:
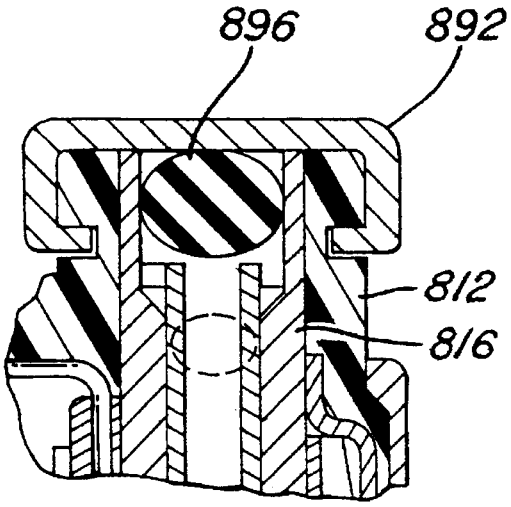

FIGS. 8 through 10 illustrate variations of a ball seal retained within the inlet tube of the associated injector. In FIG. 8, a deformable ball 696 is pressed into the end of the inlet tube 616 and is retained there by friction forces due to the press fit. In FIG. 9, an elastomeric ball 796 is forced into the end of the inlet tube 716 and is held in place by a closure disk 764 welded or otherwise retained on the end of the inlet tube. In FIG. 10, an elastomeric ball 896 is retained in place in the inlet tube 816 by a snap cap 892 clipped to the plastic housing 812 on the injector.

Figure 11:
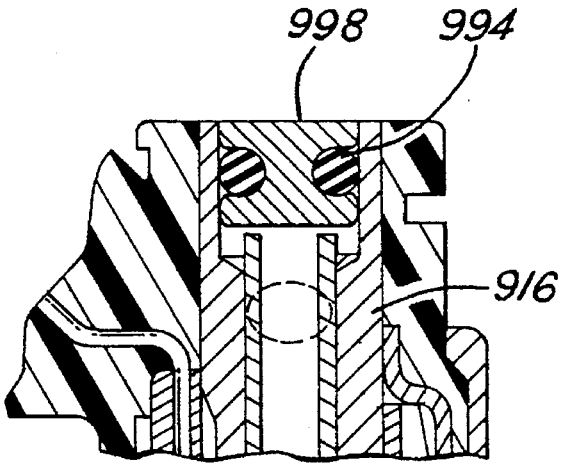

FIG. 11 differs in that the interior of the inlet tube 916 outer end is closed by a short piece of cylindrical rod 998 which is grooved to receive an internal O-ring 994 that provides the seal. The rod may be crimped, staked or welded in place within the inlet tube 916.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A bottom feed fuel injector for spraying fuel into an engine inlet air charge, the injector comprising a body having a nozzle at one axial end and a through bore from the nozzle having a closure at an opposite axial end, first and second axially spaced seals on the body intermediate the axial ends, fuel feed passages between the seals and communicating with the bore for feeding fuel to the nozzle in normal engine operation, electrically controlled valve mechanism for controlling fuel flow through the nozzle, said mechanism including an armature including a valve member biased toward closing against a seat by a spring disposed against the armature, the valve member being openable by electric actuation of the armature, an adjuster in the bore and engaging the spring for adjusting the bias of the valve member, said injector characterized in that said adjuster defines with said bore an auxiliary fuel passage from the closed axial end of said bore to said nozzle, whereby fuel may be delivered to the nozzle during calibration and run-in prior to the application of said closure.

2. A fuel injector as in claim 1 characterized in that said adjuster is a tube internally defining the auxiliary fuel passage.

3. A fuel injector as in claim 2 characterized in that said adjuster tube is a roll pin.

4. A fuel injector as in claim 1 characterized in that said adjuster is a rod having axially extending clearance between said rod and said bore defining the auxiliary fuel passage.

5. A fuel injector as in claim 1 characterized in that said closed axial end forms a tubular portion and said closure coacts with said tubular portion.

6. A fuel injector as in claim 5 characterized in that injector further includes a protective cover mounted on said closed axial end and covering said tubular portion for protection against external conditions.

7. A fuel injector as in claim 6 characterized in that said cover is a plastic cap.

8. A fuel injector as in claim 5 characterized in that said closure comprises a disk member sealed adjacent the end of said tubular portion.

9. A fuel injector as in claim 8 characterized in that said disk member is metallic and is sealed by welding to the tubular portion.

10. A fuel injector as in claim 5 characterized in that said closure is a deformable ball inserted into said tubular portion.

11. A fuel injector as in claim 5 characterized in that said closure is a cap mounted on said tubular portion and enclosing a resilient seal closing the end of said tubular portion.

12. A fuel injector as in claim 11 characterized in that said cap is held by retaining means on said tubular portion.

13. A fuel injector as in claim 12 characterized in that said retaining means provides a supplementary hermetic seal.

14. A fuel injector as in claim 11 characterized in that said resilient seal engages the end of said tubular portion.

15. A fuel injector as in claim 11 characterized in that said resilient seal engages an outer diameter of said tubular portion.

16. A fuel injector as in claim 11 characterized in that said resilient seal engages an inner diameter of said tubular portion.

17. A fuel injector as in claim 16 characterized in that said resilient seal is an elastomeric ball held in said tubular portion.

18. A fuel injector as in claim 5 characterized in that said closure is a rod retained in said tubular portion, said rod having a seal groove retaining a ring seal engaging the tubular portion.

19. A method of making a bottom feed fuel injector characterized by the steps of:

forming the injector with a conventional bottom feed fuel passage;

additionally forming the injector with a top feed fuel passage connecting internally with the bottom feed fuel passage;

calibrating the injector during manufacture by feeding calibration fluid through the top feed fuel passage while blocking the entrance to the bottom feed fuel passage to prevent fuel leakage; and after calibration, closing the top feed fuel passage to prevent fuel flow therethrough, leaving the bottom feed fuel passage for admission of fuel during normal operation.

20. A method as in claim 19 characterized by the additional step of:

running in the injector after assembly and prior to closing the top feed fuel passage while feeding fluid from the top feed fuel passage and blocking fluid flow through the bottom feed fuel passage.

* * * * *